US006397939B1

(12) United States Patent
Swiger et al.

(10) Patent No.: US 6,397,939 B1
(45) Date of Patent: Jun. 4, 2002

(54) TUBE FOR USE IN SERPENTINE FIN HEAT EXCHANGERS

(75) Inventors: J. Darin Swiger, Genoa, IL (US); Andrew J. De Rosia, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/737,253

(22) Filed: Dec. 13, 2000

(51) Int. Cl.[7] ..... F28D 1/02

(52) U.S. Cl. ..... 165/153; 165/182; 165/173; 29/890.053; 29/890.045

(58) Field of Search ..... 165/152, 153, 165/173, 182; 29/890.053, 890.045, 890.046

(56) References Cited

U.S. PATENT DOCUMENTS 3,708,012 A * 1/1973 Zimprich ..... 165/152
3,724,537 A * 4/1973 Johnson ..... 165/173
4,558,695 A * 12/1985 Kumazawa et al. ... 29/890.053
4,565,244 A 1/1986 O'Connor et al.
4,633,939 A * 1/1987 Granetzke ..... 165/154
4,653,580 A * 3/1987 Steele ..... 165/153
6,006,430 A 12/1999 Fukuoka et al.

* cited by examiner

*Primary Examiner*—Henry Bennett
*Assistant Examiner*—Terrell McKinnon
(74) *Attorney, Agent, or Firm*—Wood, Phillips, VanSanten, Clark & Mortimer

(57) ABSTRACT

Problems due to fin fall-out in the manufacture of heat exchangers having flattened tubes (14) with interposed serpentine fins (16) are eliminated by providing the exterior sides (22), (24) of the tube (14) with elongated, relatively sharp ridges (36). The ridges (36) form deformations (52) in the crests of the fins (16) which lock the fins (16) and the tubes (14) together during the brazing process, thereby preventing such fall-out.

24 Claims, 2 Drawing Sheets

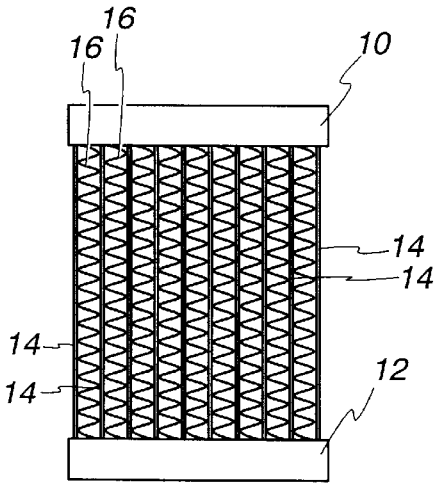
Fig. 1
Fig. 2
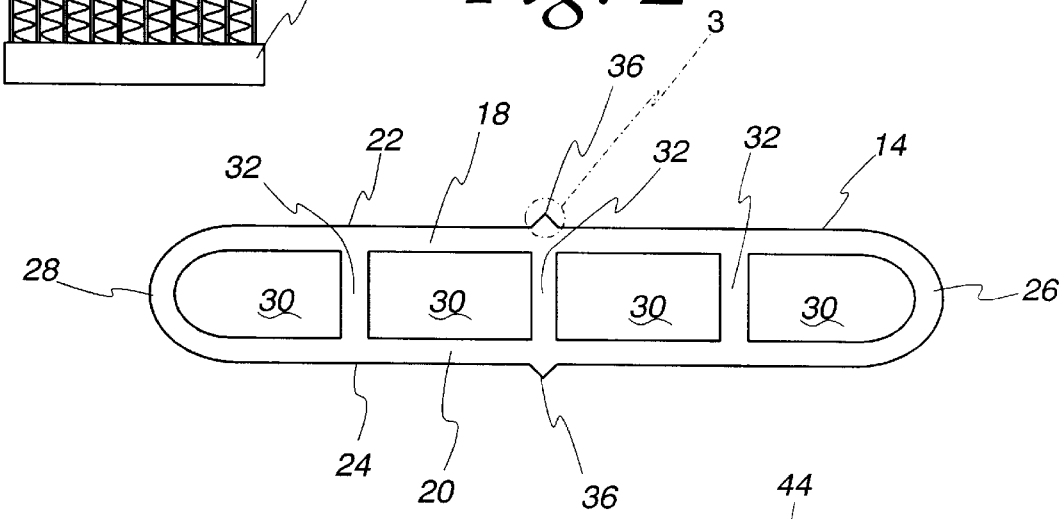
Fig. 3
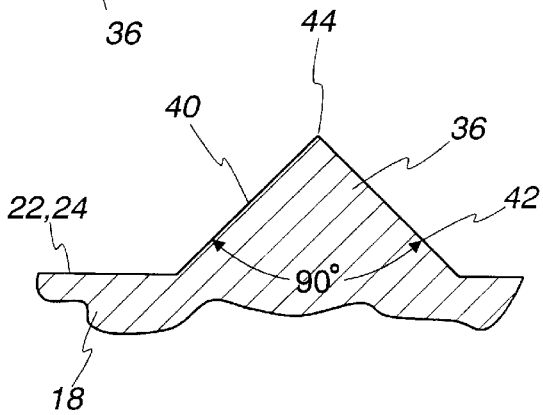
Fig. 4
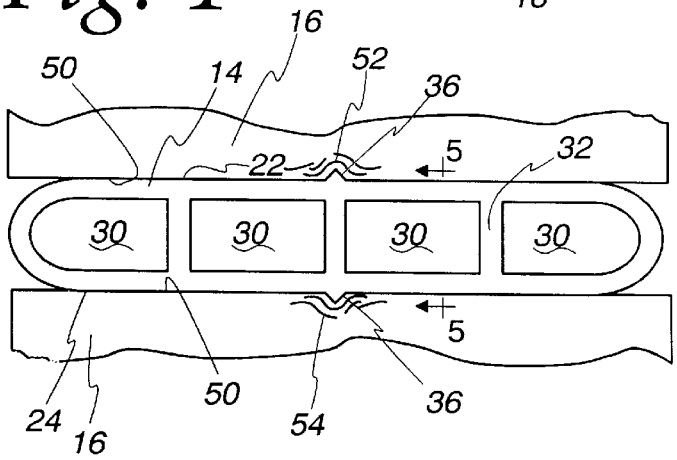

TUBE FOR USE IN SERPENTINE FIN HEAT EXCHANGERS

FIELD OF THE INVENTION

This invention relates to heat exchangers, and more particularly, to an improved tube intended for use in serpentine fin heat exchangers, particularly aluminum heat exchangers or other heat exchangers which are brazed into a final assembly. The invention also relates to a heat exchanger incorporating the improved tube as well as a method of making heat exchangers.

BACKGROUND OF THE INVENTION

In the manufacture of flat or oval tube/serpentine fin heat exchangers, a common step involves alternating pre-cut lengths of straight, flattened tube with serpentine fins. The result is a multi-layer sandwich that may be flanked on opposite sides by end pieces. This sandwich is made on a planar surface which is intended to provide support for the tubes, the fins and the end pieces to place them in a single plane. The sandwich assembly is located in ajig or a fixture which is intended to hold the heat exchanger components in a planar configuration through a brazing operation wherein all the components are metallurgically bonded together. Because it is not practical to maintain contact of every part of every component with a planar support surface during the brazing operation and still maintain an efficient brazing process, conventionally, the jig or fixture will engage the tubes and serpentine fins only at their ends. Frictional contact between the end pieces, fins and tubes is relied upon to maintain the components in a planar configuration.

Unfortunately, this method of assembly does not always operate as planned. Those skilled in the art will readily recognize that to braze components together, particularly in the case of aluminum or aluminum alloys as the temperature of the components is elevated towards the brazing temperature, all of the components soften substantially. This is particularly true of the serpentine fins which typically have a thickness half or less of the thickness of the tube wall of the tubes. Consequently, as the fins soften, the ability to grasp them frictionally between the tubes may be lost at one or more places along the face of the heat exchanger. When such occurs, the fins sag or droop under their own weight and partially or wholly droop or descend below the desired plane. In mild cases, essentially only the aesthetic appearance of the heat exchanger is affected. That is to say, operational efficiency of the heat exchanger or its ability to be used in an intended environment is not impaired. However, the appearance of being improperly made is a detriment with which manufacturers must be concerned and consequently, such a heat exchanger may be unsaleable.

In other cases, the drooping is so severe that the front to back dimension of the heat exchanger is increased to the point that the heat exchanger cannot be utilized in its intended environment because of the increased depth of its core. In such cases, efficiency may also be impaired because at locations where the drooping occurs, much of the fin crests will be out of contact with the tube and fin side heat exchange will be lowered substantially.

There have been attempts to solve this problem and the same typically focus on placing a recess in the crests of the serpentine fin. The recess is conventionally configured to match the shape of one half of the tube if the tube were separated along its major dimension. As a consequence, at both edges of the fin, tongues which may embrace both the leading and trailing edges of the tube within the heat exchanger are produced. When the sandwich of heat exchanger components is made, these tongues prevent the serpentine fins from descending from their desired positions between the tubes because the tongues partially overlie either the leading or trailing edge of the tubes in the heat exchanger. While such an approach is operative for its intended purpose, properly forming the recesses in the crests of the fins is not a totally uncomplicated process and thus adds to the expense of manufacture. Moreover, if one or more recesses are not formed or are only partially formed, distortion of the fins will result in the final product which may make the same unsaleable simply from an aesthetic standpoint.

The present invention is directed to overcoming one or more of the above problems.

SUMMARY OF THE INVENTION

It is one principal object of the invention to provide a heat exchanger that may be economically manufactured and which includes flattened tubes and serpentine fins wherein difficulties associated with fin fall-out or sagging during a brazing process are avoided.

It is also a principal object of the invention to provide a new and improved tube for use in the manufacture of flattened tube/serpentine fin heat exchangers which minimizes or eliminates the possibility of fin fall-out during the manufacturing process.

It is still another principal object of the invention to provide a method of making flattened tube/serpentine fin heat exchangers that minimizes or eliminates the possibility of fin drooping or fall-out during the manufacturing process.

According to the first mentioned object stated above, there is provided a brazed heat exchanger that includes a plurality of runs of a flattened tube having opposite flattened side walls, spaced opposite end walls interconnecting the side walls and at least one interior row of ports. The distance between the end walls is substantially greater than the distance between the side walls and such distances respectively define a tube major dimension and a tube minor dimension. A ridge is located on and projects outwardly from each side wall away from the row of ports a relatively short distance and serpentine fins are located between each of the runs and have crests brazed to the side walls of the runs adjacent thereto. The crests are slightly deformed by the ridges whereby the ridges lock the fins between the runs during a brazing process.

In a preferred embodiment, the tube runs, ridges and fins are formed of aluminum.

Preferably, the tube or tubes of which the runs are formed are extruded.

According to another facet of the invention, a tube for use in a heat exchanger of the type having serpentine fins located between parallel tubes disposed in a row is provided. The tube is a flattened tube or oval having opposed, flattened, spaced side walls interconnected by opposite end walls with the distance between the side walls being less than the distance between the end walls to respectively define a tube minor dimension and a tube major dimension. At least one row of ports extending between the end walls and located within the side walls is provided. Also provided is an elongated ridge on the exterior of each of the side walls that extends outwardly therefrom and away from the row of ports. The ridge is adapted to engage and slightly deform the crests of an adjacent serpentine fin and has a height insufficient to separate the crests from the exterior of the associated side walls sufficiently to prevent the formation of a brazed joint between the fin and the side wall along substantially the entire length of the crest.

Again, in a preferred embodiment, the tube is an extruded aluminum tube.

In one embodiment, each ridge is prism-shaped.

In a preferred embodiment, each of the ridges includes two sides meeting at an apex and in a highly preferred embodiment, the ridge extends away from the associated side wall a distance in the range of about 0.005 inches to about 0.05 inches as measured to the apex.

A preferred embodiment also contemplates that the included angle at the apex is on the order of 90°.

In one embodiment, the ridges are substantially centered between the end walls of the tube.

According to the third principal object of the invention mentioned above, there is provided a method of brazing a heat exchanger that includes the steps of: a) providing a tube matrix including a plurality of spaced tube runs in a predetermined relation with the runs having flattened sides facing adjacent runs and ridges extending the length of the runs and extending outwardly from the flattened sides thereof, b) locating serpentine fins between adjacent runs with crests of the fins substantially engaging the ridges; c) reducing the spacing between the runs so that c-1) the ridges are driven into the crests to frictionally lock the runs and the fins together and c-2) the crests are brought into substantial abutment with the flattened sides. The method also includes the step of d) subjecting the assembly resulting from step c-1) and c-2) to brazing temperatures for a sufficient period of time to braze the runs and the fins together.

In a preferred embodiment, step a) includes the step of providing an extruded aluminum tube.

According to a preferred embodiment, step a) also includes the step of providing the tube matrix as a plurality of straight tube runs.

In an even more preferred embodiment of the invention, step a) includes the step of providing the straight tube runs as individual pieces of tubes.

A preferred embodiment of the invention contemplates that the ridges be shaped as prisms having a fin engaging apex.

In a highly preferred embodiment of the invention contemplates that the apex extend from the flattened sides at a distance in the range of about 0.005 inches to about 0.05 inches.

In a very highly preferred embodiment, the apexes having an included angle on the order of 90°.

Other objects and advantages will become apparent from the following specification taken in connection with the accompanying drawings.

DESCRIPTION OF THE DRAWINGS

FIG. 1 is a side elevation of a flattened tube, serpentine fin heat exchanger made according to the invention;

FIG. 2 is a cross-section of a tube made according to the invention;

FIG. 3 is an enlarged, fragmentary sectional view of part of the tube;

FIG. 4 is a sectional view taken approximately along the line 4—4 in FIG. 5;

DESCRIPTION OF THE PREFERRED EMBODIMENTS

Figure 5:
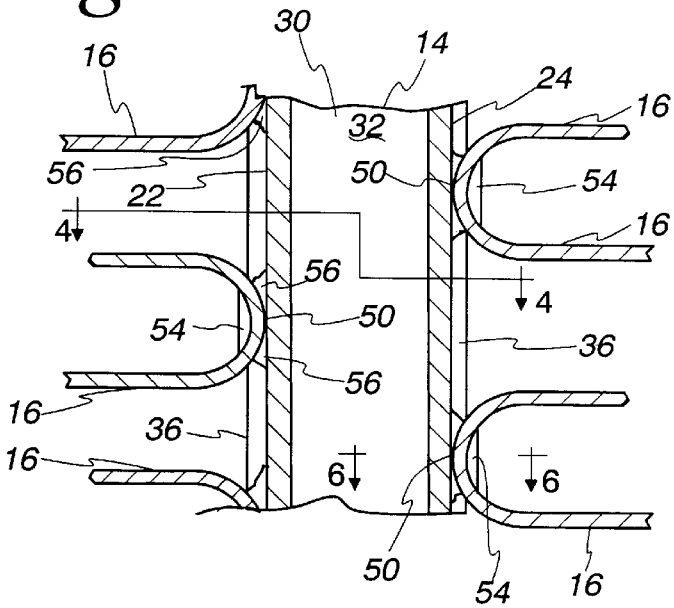
FIG. 5 is a sectional view taken approximately along the line 5—5 in FIG. 4.

An exemplary embodiment of a heat exchanger made according to the invention is illustrated in FIG. 1 in the form of a parallel flow heat exchanger. However, it is to be understood that the invention may be employed with equal efficacy in serpentine heat exchangers, hybrid parallel flow/serpentine heat exchangers and even those where a tube intended to carry a heat exchange fluid is wound in concentric loops which are spaced by serpentine fins. The heat exchanger illustrated in FIG. 1 includes first and second combined header and tank assemblies 10, 12 which are generally parallel to one another and spaced from one another. When combined header and tank assemblies are utilized, frequently, the same will be formed of tubes provided with aligned slots for receiving a row of tubes 14 which extend between the header and tank assemblies 10, 12 and are in fluid communication with the interior. It is to be noted, however, that separate header plates fitted with tanks may be used in lieu of the combined header and tank assemblies 10, 12.

In a parallel flow type of embodiment, the tubes 14 are individual pieces of tubes which are spaced from one another and which are parallel to one another. In the spaces between adjacent tubes, conventional serpentine fins 16 are utilized and conventionally extend from one header and tank assembly 10 to the other 12.

Though not shown in FIG. 1, it is usual to provide end pieces that sandwich a serpentine fin 16 against the end-most ones of the tubes 14 and which extend between the header and tank assemblies 10, 12.

Turning to FIG. 2, one of the tubes 14 is shown in enlarged detail in cross-section. The same is a so-called flattened tube or oval tube having opposite side walls 18, 20 which are spaced from one another and which have external surfaces 22, 24 respectively. The distance between the external surfaces 22, 24 is conventionally referred to as the tube minor dimension.

Tube 14 also includes arcuate end walls 26, 28 which interconnect the side walls 18, 20. The end walls 26, 28, and specifically, those points of their external surfaces most remote from the other, are spaced a distance conventionally referred to as the tube major dimension.

Extending between the end walls 26, 28 and located between the side walls 18, 20 are a plurality of ports 30. The ports 30 are separated by internal webs 32 which provide heat exchange surface within the interior of the tube 14 and which provide strength to the tube 14 to resist internal pressure of a fluid flowing within the ports 30. In the construction illustrated, the walls of the webs 30 merge with the interior of the side walls 18, 20 at approximately 90° to thereby define an elongated crevice which, for relatively small hydraulic diameters, further enhances heat transfer.

As regards hydraulic diameter, it is preferred that the hydraulic diameter of each of the ports 30 is 0.07 inches or less to maximize efficiency. Preferably, the hydraulic diameter of the ports is 0.040 inches or less for a maximum improvement in efficiency. However, it is to be particularly noted that where heat transfer efficiency is not a major concern, larger hydraulic diameters may be employed.

The tube 14 is completed by the presence of an elongated ridge 36 extending in the direction of elongation of the tube 14. One of the ridges 36 is located on each of the external surfaces 22, 24 of the side walls 18, 20. In general, the ridges 36 will be centered along the tube major dimension which is to say, in a construction such as shown in FIG. 2 where three of the webs 32 are employed, the same will be aligned with and located oppositely of the center or second web which provides support for the side walls 18, 20 when a fin 16 is pressed against the ridge 36 as will be seen.

FIG. 3 shows an enlargement of a typical ridge 36. The same is seen to be generally prism-shaped, that is, defined by the convergence of two straight surfaces 40, 42 at an apex 44. The apex 44 is thus relatively sharp. Preferably, the surfaces 40, 42 are at an approximately 45° angle to the external surface 22, 24 and the apex 44 has o an included angle of 90°.

In the usual case, the height of each ridge 36 will be in the range of about 0.005 inches to about 0.050 inches.

Figure 6:
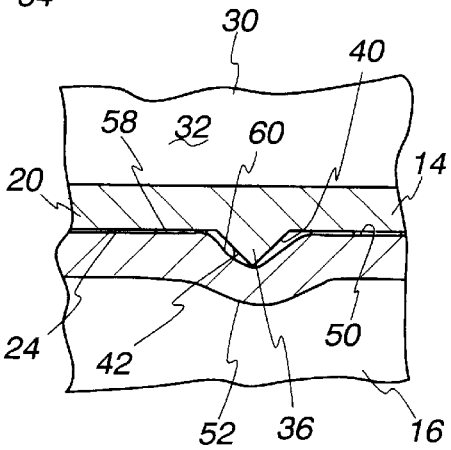
FIG. 6 is an enlarged, fragmentary sectional view taken approximately along the line 6—6 in FIG. 5.

Turning now to FIGS. 4–6, inclusive, the interaction of the ridges 36 with a serpentine fin 16 to achieve the objects of the invention will be described. Referring specifically to FIGS. 4 and 5, it will be seen that the exterior surfaces 22, 24 of the tube 14 are abutted by respective ones of serpentine fins 16, namely, the adjacent serpentine fin. More particularly, and with reference to FIG. 5, it will be seen that the surfaces 22, 24 are abutted by the crests 50 of the serpentine fins 16. At the same time, the ridges 36 are pressed inwardly into the crests 50. The crests are slightly deformed as illustrated in an area 52 as shown in FIG. 4 while the external surfaces 22, 24 remain in their original shape. FIG. 5 is an enlarged, sectional view and shows the deformation of each crest 50, also with the reference numeral 54. The crests are bonded as by brazing to both the exterior sides 22, 24 and fillets of brazing material are illustrated at 56. Turning to FIG. 6, an enlarged sectional view of one interface of a tube side wall 20, and specifically the external surface 24 thereof with the crests 50 of the fins 16 as well as the interface of the crests 50 of the fins 16 with one of the ribs 36 is illustrated. As can be seen, a thin layer of braze alloy 58 extends along the interface of the crest 50 with the exterior surface 24. In addition, brazed material.60 fills any spacing between the sides 40,42 of the ridge 36 at the point of deformation 52 of the crests 50 so as to provide a tight, uniform, good heat transfer effecting bond between each of the crests 50 of each serpentine fin 16 and the adjacent tube 14.

Figure 7:
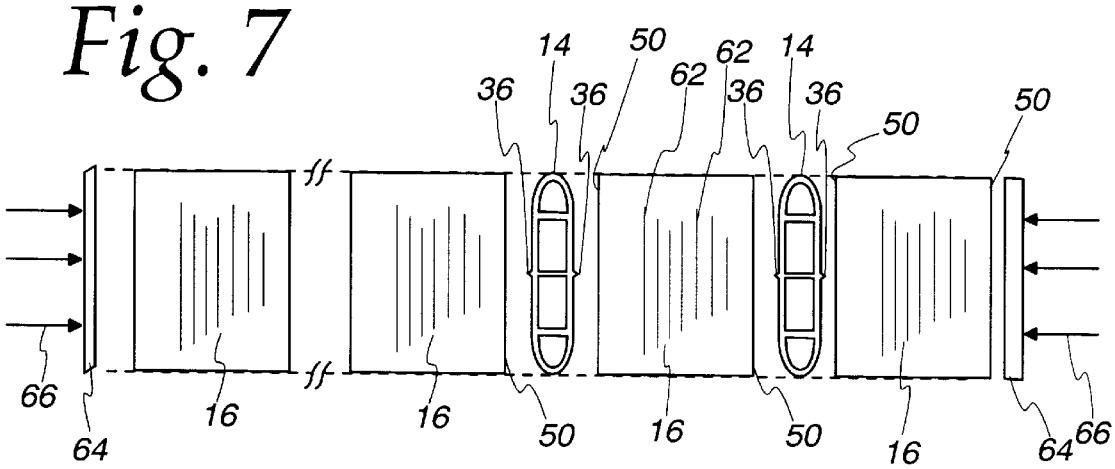
FIG. 7 is a view somewhat schematically illustrating a step in a method forming part of the invention.

As generally alluded to previously, the purpose of the ridges 36 is to deform, ever so slightly, the crests 50 of the serpentine fins 16 to thereby lock the tube 14 and the fins 16 against relative movement, even when the latter is softened at brazing temperatures. More particularly, the usual process of assembling the tubes 14 and the fins 16 in a sandwich relation along with end plates, if used, is followed. One alternates the tubes 14 with the fins 16, which may be louvered fins having louvers such as shown at 62 in FIG. 7. The resulting multi-layer sandwich of tubes 14 and fins 16 may be placed between side plates 64 or the side plates may be omitted if desired. In any event, a compressive force illustrated by arrows 66 acting against the side plates in the embodiment illustrated in FIG. 7 is applied to the assembly. The compressive force is such as to reduce the spacing between the tube runs 14 so that the ridges 36 are driven into the crests 50 to achieve the foregoing deformation and frictional lock between the tubes 14 and the fins 16. If desired, the ridges 36 may also be employed on the end plates 64. The reduction in spacing provided by the compressive force is also such that the crests 50 are brought into substantial abutment with the flattened exterior sides 22, 24 of the side walls 14 and 16. This may be done in a conventional jig or brazing fixture which may then be placed in a brazing oven to braze the assembly together so that the configuration of components illustrated in FIGS. 4, 5, and 6 results. This provides a good brazed bond along the entire length of each crest 50 both on the flat exterior surfaces 22, 24 and on both sides 40, 42 of the crests 36. Consequently, excellent heat transfer is obtained between the fins 16 and the tubes 14.

Most significantly, even as the fins 16 soften during the brazing process and would tend to sag out of the plane of the assembly of the tubes 14, fins 16, and end plates 64 if used, they cannot do so because of the presence of the ridges 36 and the resulting deformation 52 in the crests of the fins 50. That is, the ridges 36 and deformation 52 form an interference fit at their interface. As a result, so-called "fin fall-out" is minimized or eliminated altogether. Consequently, heat exchangers made unusable as a result of fin fall-out are reduced substantially in number to provide for a more economical manufacturing process as well as a more efficient and/or aesthetically pleasing heat exchanger.

In a preferred embodiment, the tubes 14 are extruded tubes, and even more preferably, are extruded aluminum tubes. In the usual case, the fins 16 will be clad to on both sides, with a brazing alloy to provide the fillets 56 (FIG. 5) and the braze alloy layers 56, 60 (FIG. 6), although in some cases, the brazing alloy may be placed on the exterior side walls 22, 24 of the tubes 14 instead. However, the invention is applicable to systems employing non-aluminum based metals which are brazed together as well as to non-extruded tubes. For example, fabricated tubes formed by roll forming a strip of metal could also be provided with the ribs 36 as the strip is formed and/or prior to processing into tubes.

Desirably, a relatively high included angle, such as an angle on the order of the 90° angle shown in the exemplary embodiment, between the sides 40, 42 at the apex is desirable to provide ridges 36 that cannot collapse as by bending that might occur if a considerably lesser included angle were employed.

It is also desired that the height of each ridge, that is, the distance between each apex 54 and the corresponding external surface 22, 24 in a direction at right angles to the surfaces 22,24 be in the aforementioned range of 0.005 inches to 0.050 inches. If the ridge height is too short, there may be insufficient formation of the deformations 52 in the fin crests 50 to achieve the desired frictional lock. Conversely, if the height of the ridges 36 is too great, there may be so much deformation that the point of engagement with the ridges 36 that part of the crests 50 will be separated from the external surface 22, 24 as the case may be leading to poor heat transfer because of such separation. Moreover, excessive ridge height will reduce fin side free flow area resulting in a higher fin sides pressure drop and/or decreased fin side heat exchange efficiency.

From the foregoing, it will be readily appreciated that a tube made according to the invention and a heat exchanger employing such tube solve the problems mentioned previously, including those where recesses are formed in the apex of the fin and are of such size as to receive the entirety of one side of the tube. Thus, the invention not only provides an improved heat exchanger from the standpoint that the same may be manufactured without fear of fin fall-out, it provides a new and improved tube for use in making such heat exchangers as well as an improved method of making heat exchangers.

We claim:

1. A tube for use in a heat exchanger of the type having serpentine fins located between parallel tubes disposed in a row, said tube comprising:

a flattened tube having opposed flattened, spaced side walls interconnected by opposite end walls with the distance between said side walls being less than the distance between said end walls to respectively define a tube minor dimension and a tube major dimension;

at least one row of ports in said tube extending between said end walls and located within said side walls; and an elongated ridge on the exterior of each of said side walls extending outwardly therefrom and away from said row of ports;

said ridge being adapted to engage and slightly deform the crests of an adjacent serpentine fin and having a height insufficient to separate the crests from the exterior of the associated side walls sufficiently to prevent the formation of a brazed joint between the fin and side wall along substantially the entire length of the crest.

2. The tube of claim 1 wherein the tube is an extruded aluminum tube.

3. The tube of claim 2 wherein each said ridge is prism shaped.

4. The tube of claim 2 wherein each said ridge includes two sides meeting at an apex.

5. The tube of claim 1 wherein each said ridge extends away from the associated side wall a distance in the range of about 0.005 inches to about 0.05 inches.

6. The tube of claim 5 wherein each said ridge includes two sides meeting at an apex.

7. The tube of claim 6 wherein the included angle at said apex is on the order of 90°.

8. The tube of claim 1 wherein said ridges are substantially centered between said end walls.

9. A brazed heat exchanger comprising:

a plurality of runs of flattened tube having opposite flattened side walls, spaced opposite end walls interconnecting the side walls and at least one interior row of ports, the distance between said end walls being substantially greater than the distance between said side walls and respectively defining a tube major dimension and a tube minor dimension;

a ridge on and projecting outwardly from each side wall away from said row of ports a relatively short distance; and serpentine fins located between each of said runs and having crests brazed to the side walls of the runs adjacent thereto, said crests being slightly deformed by said ridges whereby said ridges lock said fins between said runs during a brazing process.

10. The heat exchanger of claim 9 wherein said runs, said ridges and said fins are formed of aluminum.

11. The heat exchanger of claim 10 wherein said runs are extruded.

12. The tube of claim 11 wherein each said ridge extends away from the associated side wall a distance in the range of about 0.005 inches to about 0.05 inches.

13. The tube of claim 12 wherein each said ridge includes two sides meeting at an apex.

14. The tube of claim 13 wherein the included angle at said apex is on the order of 90°.

15. The tube of claim 9 wherein said ridges are substantially centered between said end walls.

16. The heat exchanger of claim 9 wherein said runs are formed of individual pieces of said tube.

17. A method of brazing a heat exchanger comprising the steps of:

a) providing a tube matrix including a plurality of spaced tube runs in a predetermined relation with the runs having flattened sides facing adjacent runs and ridges extending the length of the runs and extending outwardly from the flattened sides thereof;

b) locating serpentine fins between adjacent runs with crests of the fins substantially engaging the ridges;

c) reducing the spacing between the runs so that c-1 the ridges are driven into the crests to frictionally lock the runs and the fins together; and c-2 the crests are brought into substantial abutment with said flattened sides; and d) subjecting the assembly resulting from steps c-1 and c-2 to brazing temperatures for a sufficient period of time to braze said runs and said fins together.

18. The method of claim 17 wherein step a) includes the step of providing an extruded aluminum tube.

19. The method of claim 18 wherein step a) includes providing said tube matrix as a plurality of straight tube runs.

20. The method of claim 19 wherein step a) includes providing said straight tube runs as individual pieces of tube.

21. The method of claim 20 wherein step a) includes providing said ridges as prism shaped ridges having a fin engaging apex.

22. The method of claim 21 wherein step a) includes providing apexes that extend from said flattened sides a distance in the range of about 0.005 inches to about 0.05 inches.

23. The method of claim 22 wherein step a) includes providing apexes with an included angle on the order of 90°.

24. The method of claim 21 wherein step a) includes providing apexes with an included angle on the order of 90°.

* * * * *

Disclaimer 6,397,939—J. Darin Swiger, Genoa, IL (US); Andrew J. De Rosia, Racine WI (US). TUBE FOR USE IN SERPENTINE FIN HEAT EXCHANGERS. Patent dated June 4, 2002. Disclaimer filed November 25, 2002, by the assignee, Modine Manufacturing Company.

Hereby enters this disclaimer to claims 1, 2, 4, 8, 9, 10, 11, 15, 16, 17, 18, 19, and 20, of said patent.

*(Official Gazette, March 2, 2004)*